US006506036B2

(12) United States Patent
Tsubai et al.

(10) Patent No.: US 6,506,036 B2
(45) Date of Patent: Jan. 14, 2003

(54) SCROLL COMPRESSORS

(75) Inventors: Shinji Tsubai, Kariya (JP); Hiroyuki Gennami, Kariya (JP); Kazuhiro Kuroki, Kariya (JP); Kazuo Kobayashi, Kariya (JP); Naohiro Nakajima, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/952,220

(22) Filed: Sep. 13, 2001

(65) Prior Publication Data

US 2002/0064474 A1 May 30, 2002

(30) Foreign Application Priority Data

Sep. 13, 2000 (JP) ..... 2000-278506

(51) Int. Cl.[7] ..... F04C 18/04

(52) U.S. Cl. ..... 418/55.4; 418/55.5; 418/57; 418/188; 417/369

(58) Field of Search ..... 418/55.4, 188, 418/55.5, 57; 417/369

(56) References Cited

U.S. PATENT DOCUMENTS 5,681,155 A 10/1997 Hisanaga et al.

FOREIGN PATENT DOCUMENTS

JP 05288167 A * 11/1993 ..... 418/55.1
JP 06010864 A * 1/1994 ..... 418/55.1
JP 11-6487 11/1999

* cited by examiner

*Primary Examiner*—Thomas Denion
*Assistant Examiner*—Theresa Trieu
(74) *Attorney, Agent, or Firm*—Morgan & Finnegan, LLP

(57) ABSTRACT

Scroll compressors may preferably include a stationary scroll, a drive shaft, a crank shaft coupled to the drive shaft and a bush coupled to the outer surface of the crank shaft. A seal is preferably disposed between the bush and the crank shaft and the seal is elastically deformable in the radial direction of the crank shaft. A movable scroll may be coupled to the crank shaft and disposed adjacent to the stationary scroll. A compression chamber is defined by a space between the stationary scroll and the movable scroll, such that fluid is compressed within the compression chamber when the movable scroll revolves or orbits with respect to the stationary scroll. Further, a discharge port is preferably defined within the movable scroll and adapted to release the compressed fluid to a side that is opposite of the stationary scroll.

15 Claims, 3 Drawing Sheets

SCROLL COMPRESSORS

BACKGROUND OF THE INVENTION

1. Field of the Invention

The present invention relates to scroll compressors that may compress fluid by utilizing stationary and movable scrolls and more particularly, to scroll compressors that can efficiently seal a high-pressure chamber or space within the scroll compressors. Such scroll compressors may be utilized in air conditioning systems and more preferably in vehicle air conditioning systems.

2. Description of the Related Art

A known scroll compressor is disclosed in Japanese Laid-open Patent Publication No. H11-6487, which scroll compressor includes a stationary scroll and a movable scroll disposed within a compressor housing. A compression chamber is defined by a space between the stationary scroll and the movable scroll. When the movable scroll moves with respect to the stationary scroll, the volume within the compression chamber is reduced and thus, fluid drawn into the compression chamber is compressed and discharged from the discharge port. The discharge port is provided within the movable scroll in accordance with the compression chamber in its minimum volume. Fluid compressed in the compression chamber is discharged opposite to the stationary scroll. Further, the movable scroll has a boss that extends opposite to the stationary scroll. The boss is coupled to a drive shaft member such that the drive shaft member causes the movable scroll to move along an orbital path.

In order to prevent the compressed fluid from leaking to a lower-pressure chamber or space within the compressor housing, a seal is provided between the base plate of the movable scroll and the compressor housing so as to surround the boss of the movable scroll. However, according to the known scroll compressor, a relatively large area must be sealed in order to prevent the compressed fluid from leaking to the lower-pressure space, because the seal surrounds the outer circumferential surface of the boss.

SUMMARY OF THE INVENTION

It is therefore an object of the invention to provide improved scroll compressors that can effectively prevent the compressed fluid from leaking to a low-pressure space within the compressor.

In the representative scroll compressor according to the present teachings, fluid compressed by utilizing a stationary scroll and a movable scroll is discharged from a discharge port provided with the movable scroll. As the result, fluid is discharged opposite to the stationary scroll. The movable scroll revolves or orbits with respect to a drive shaft by means of a crank shaft. A bush is coupled to the outer surface of the crank shaft. A seal is provided between the bush and the crank shaft. Further, the seal may elastically deform in the radial direction of the crank shaft.

According to the present teachings, the high-pressure fluid can be prevented from leaking to low pressure spaces by sealing a relatively small area between the bush and the crank shaft. Therefore, the tight seal can be provided. Further, because the seal can elastically deform in the radial direction of the crank shaft, the impact of the bush contacting the crank shaft, due to the compression force at the initial stage of operating the scroll compressor, can be reduced or alleviated.

Other objects, features and advantage of the present invention will be readily understood after reading the following detailed description together with the accompanying drawings and the claims.

DETAILED DESCRIPTION OF THE INVENTION

Figure 1:
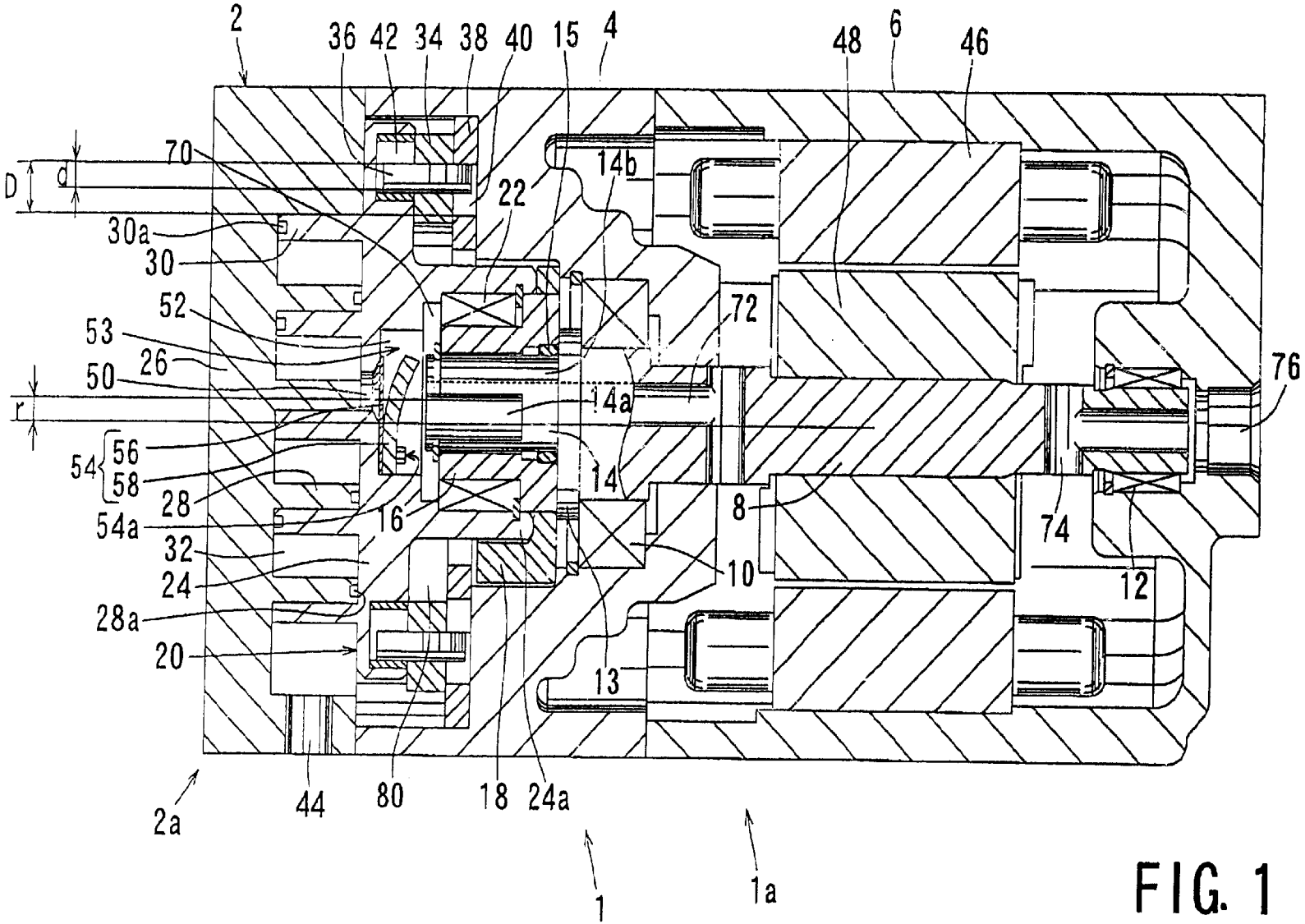
FIG. 1 shows the representative scroll compressor.

Representative scroll compressors are taught that may preferably include a stationary scroll, a drive shaft, a crank shaft, a bush, a movable scroll, a compression chamber and a discharge port.

The crank shaft may be coupled to the drive shaft and the bush may be coupled to the outer surface of the crank shaft. The crank shaft causes the movable scroll to generally orbit along a circular path with respect to the stationary scroll. The compression chamber is defined by a space between the stationary scroll and the movable scroll. Fluid may be compressed in the compression chamber when the movable scroll moves or orbits with respect to the stationary scroll. The discharge port is defined within the movable scroll in order to release the compressed fluid to the opposite side of the stationary scroll.

Preferably, a seal is disposed between the bush and the crank shaft. The circumferential length of the clearance between the bush and the crank shaft is much loss, for example, than the circumferential length of the clearance between the boss of the movable scroll and the compressor housing. Therefore, the sealing area can be minimized and thus, high sealing efficiency can be obtained. As another aspect of the present teachings, the seal may elastically deform in the radial direction of the crank shaft. Moreover, the bush may possibly impact or strike the crank shaft due to the reaction force caused by the compression of the fluid, especially when the operation of the scroll compressor is started. In such case, the seal can receive the displacement of the bush toward the crank shaft. As the result, the seal elastically deforms in the axial direction of the crank shaft to receive the displacement of the bush and can alleviate the collision of these two elements.

In another aspect Of the present teachings, the seal may preferably be defined as an annular ring. The annular ring may preferably elastically deform in the radial direction of the crank shaft.

Preferably, a base plate may be provided between the drive shaft and the crank shaft and the seal may preferably contact the base plate. By contacting the base plate, the sealing efficiency will be increased. Further, the seal may preferably be pushed towards the base plate by the fluid compressed in the compression chamber and discharged from the discharge port. By pushing the seal towards the base plate, the sealing efficiency can be increased.

Each of the additional features disclosed above and below may be utilized separately or in conjunction with other features to provide improved scroll compressors for designing and using such scroll compressors. Representative examples of the present invention, which utilizes many of these additional features in conjunction, will now be described in detail with reference to the drawings. This detailed description is merely intended to teach a person of skill in the art further details for practicing preferred aspects of the present teachings and is not intended to limit the scope of the invention. Only the claims define the scope of the claimed invention. Therefore, combinations of features disclosed in the following detail description may not be necessary to practice the invention in the broadest sense, and are instead taught merely to particularly describe some representative examples of the invention, which detailed description will now be given with reference to the accompanying drawings.

Figure 2:
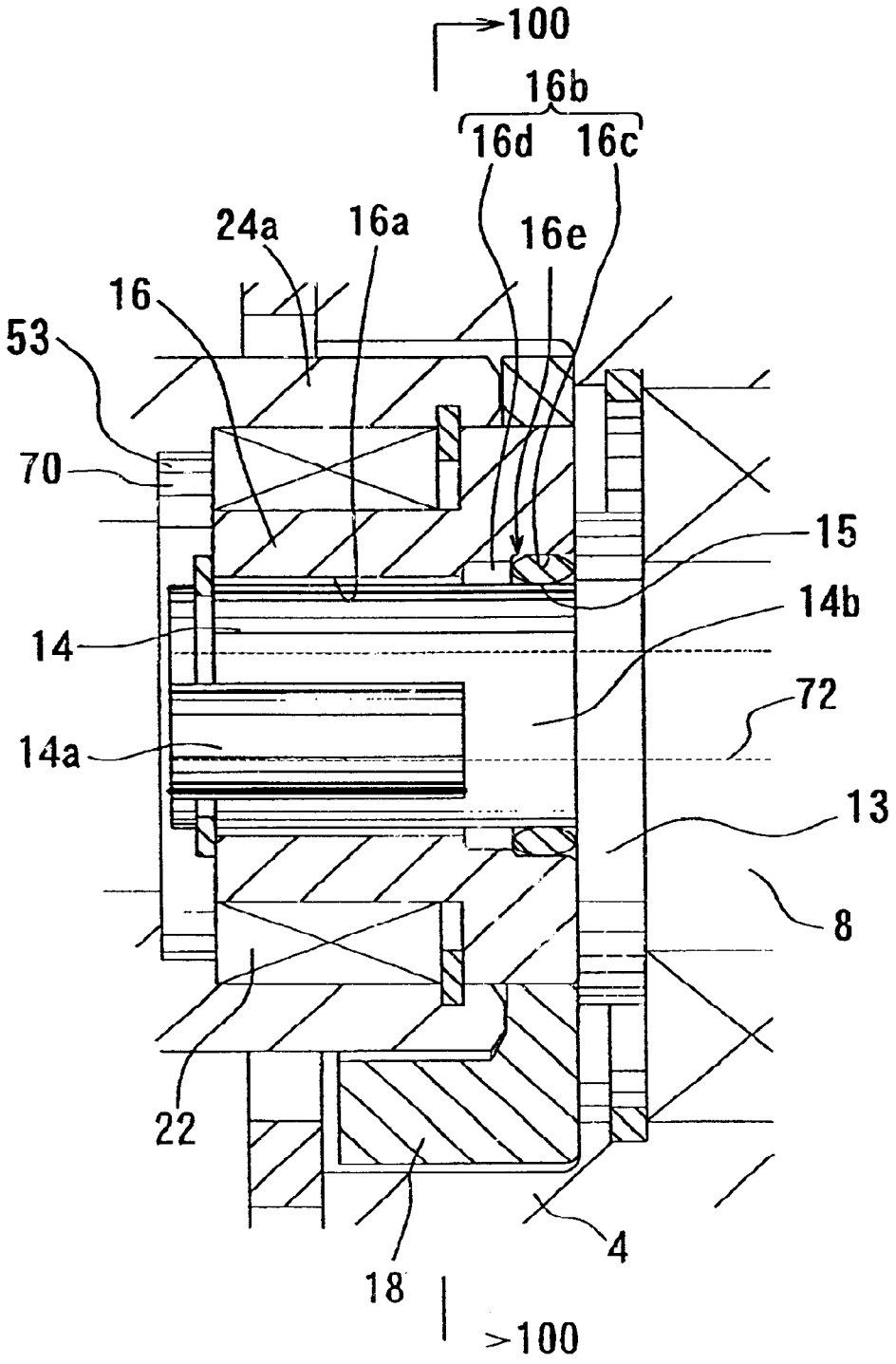
FIG. 2 partially shows the bush and the crank shaft in detail.
Figure 3:
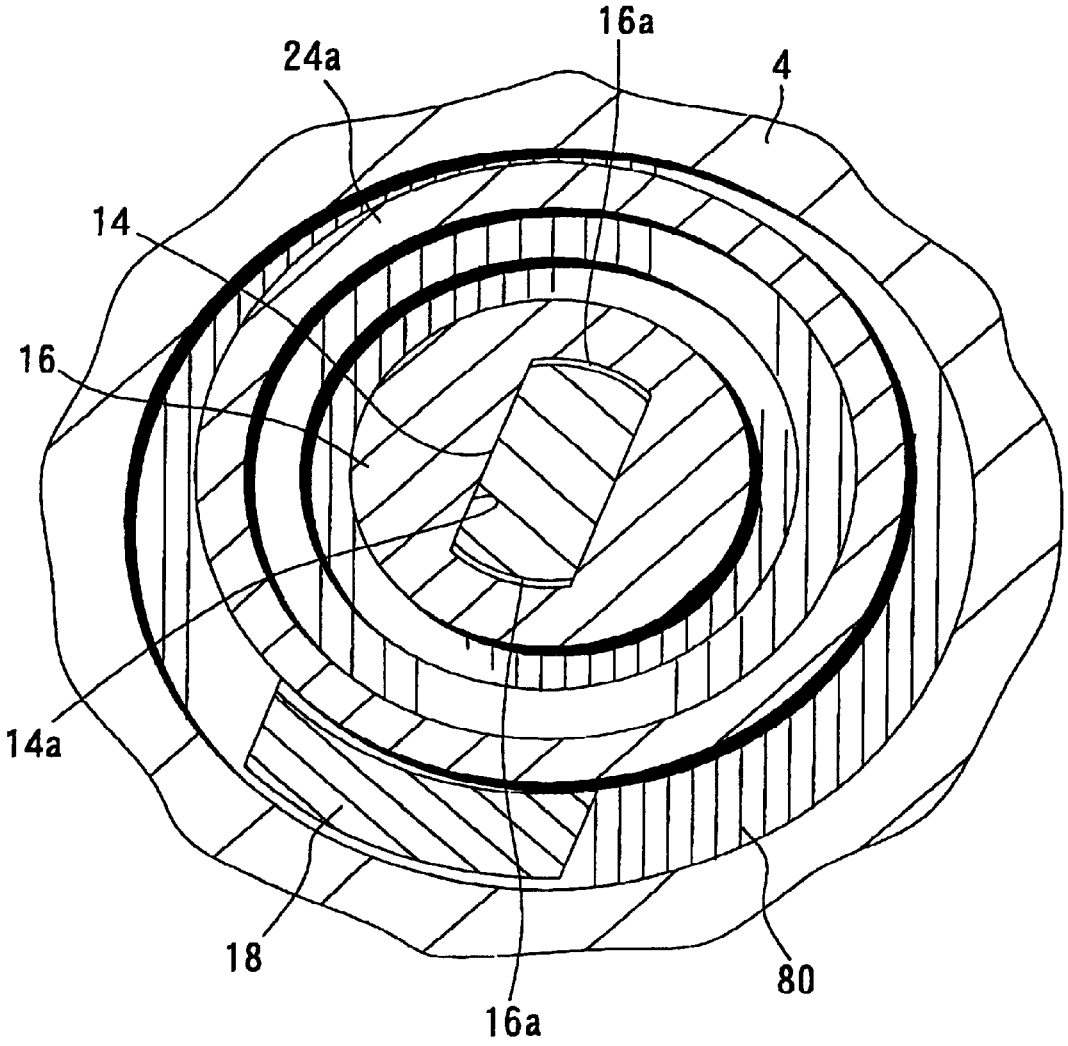
FIG. 3 shows a cross-sectional view along line 100—100 in FIG. 2.

A representative scroll compressor is shown in FIGS. 1 to 3 and may preferably be utilized within a coolant circulation circuit in a vehicle air-conditioning system. As shown in FIG. 1, a representative scroll compressor 1 includes a housing la defined by a center housing 4, a motor housing 6 and an end housing 2*a*. A stationary scroll 2 is provided within the end housing 2*a*. A movable scroll 20 and other appropriate devices for driving the movable scroll 20 are disposed within the housing 1*a*. One end surface of the center housing 4 is coupled to the end housing 2*a* and another end surface of the center housing 4 is coupled to the motor housing 6. A drive shaft 8 is rotatably supported by radial bearings 10 and 12 in both the center housing 4 and the motor housing 6. Within the center housing 4, a crank shaft 14 is integrally coupled to the end of the drive shaft 8. Although the drive shaft 8 is driven by an electric motor disposed in motor housing 6 in this representative embodiment, the present teachings are also naturally applicable to scroll compressors, in which the drive shaft 8 is driven by the vehicle engine via belts, for example.

Two mutually parallel planar portions 14*a* are defined on the crank shaft 14. In FIG. 1, however, only one planar portion 14*a* is shown for the sake of convenience of explanation. A bush 16 is joined by means of the planar surfaces 14*a* so that the bush 16 may rotate together with the crank shaft 14. A balancing weight 18 is attached to one end of the bush 16 so that the balancing weight 18 can rotate together with the crank shaft 14. The movable scroll 20 includes a tubular boss 24*a* on the surface opposite to the stationary scroll 2 (on the right side of the movable scroll 20 in FIG. 1). Further, the bush 16 is coupled to the inner circumferential surface of the boss 24*a* by means of a needle bearing 22. FIG. 3 shows a cross sectional view of the crank shaft 14, bush 16 and balancing weight 18.

The stationary scroll 2 includes a stationary volute wall 28 that protrudes from a base plate 26 of the stationary scroll 2 towards the movable scroll 20. The movable scroll 20 includes a movable volute wall 30 that protrudes from the base plate 24 of the movable scroll 20 towards the stationary scroll 2. The stationary volute wall 28 and the movable volute wall 30 are disposed adjacent to each other and preferably aligned to engage or mesh with each other. An end seal 28*a* is provided on the top end of the stationary volute wall 28 and an end seal 30*a* is provided on the top end of the movable volute wall 30. The volute walls are also known in the art as spiral wraps and these terms can be utilized interchangeably.

The stationary volute wall 28 and the movable volute wall 30 make contact with each other and are positioned in meshing engagement. As the result, a compression chamber 32 with a crescent shape is defined within a space surrounded by the stationary scroll base plate 26, the stationary volute wall 28, the movable scroll base plate 24 and the movable volute wall 30. When the drive shaft 8 rotates, the crank shaft 14 revolves or orbits around the rotational axis of the drive shaft 8. The rotational axis may be defined as the center, longitudinal axis of the drive shaft 8. Thus, the distance between the crank shaft 14 and the rotational axis of the drive shaft 8 defines the diameter of the orbital path. When the movable scroll 20 revolves or orbits about the rotational axis of the drive shaft 8, the balancing weight 18 offsets the centrifugal force caused by the revolution of the movable scroll 20.

A discharge port 50 is defined within the base plate 24 of the movable scroll 20. Further, a discharge valve 54 is provided within a valve chamber 52. The valve storage chamber 52 is defined by a space on the rear surface (the surface opposing the crank shaft 14) of the base plate 24 of the movable scroll 20. The discharge valve 54 is disposed Lo face the discharge port 50 in order to open and close the discharge port 50. The discharge valve 54 includes a reed valve 56 and a retainer 58. Thus, the reed valve 56 preferably opens and closes the discharge port 50 and has a shape that is sufficient to cover the opening of the discharge port 50. The retainer 58 faces the reed valve 56 and is disposed on the opposite side of the discharge port 50. Within the valve storage chamber 52, the reed valve 56 and the retainer 58 are fixed to the rear surface of the base plate 24 of the movable scroll 20 by means of a bolt 54*a*.

The rear surface of the base plate 24 of the movable scroll 20 faces a high-pressure chamber 53 that is defined by the valve storage chamber 52 and a space 70. The reed valve 58 is opened and closed based upon the pressure difference between the pressure within the high-pressure chamber 53 and the pressure within the compression chamber 32 (which is equal to the pressure within the discharge port 50). The reed valve 56 opens the discharge port 50 when the pressure within the compression chamber 32 is greater than the pressure within the high-pressure chamber 53. The reed valve 54 closes the discharge port 50 when the pressure within the compression chamber 32 is lower than the pressure within the high-pressure chamber 53. The retainer 56 holds the reed valve 54 and also defines the maximum aperture of the reed valve 54.

A rotary ring 34 is disposed between the base plate 24 of the movable scroll 20 and the center housing 4. The rotary ring 34 includes rotation preventing pins 36 that penetrate toward the movable scroll 20. In this embodiment, a total of four rotation preventing pins 36 are provided. However, only two rotation preventing pins 36 are shown in FIG. 1. A bearing plate 38 is provided between the center housing 4 and the rotary ring 34. Each rotation preventing pin 36 respectively engages with an rotation preventing hole 40 defined within the bearing plate 38. Further, each rotation preventing pin 36 engages with an rotation preventing hole 42 defined within base plate 24 of the movable scroll 20. The end portion of the rotation preventing pin 36 is inserted into each corresponding rotation preventing holes 40, 42.

A stator 46 is provided on the inner circumferential surface of the motor housing 6. Further, a rotor 48 is coupled to the drive shaft 8. The stator 46 and the rotor 48 define an electric motor that rotates the drive shaft 8. Thus, the present scroll compressors are particularly useful for hybrid or electric cars that operate using electric power. However, an electric motor is not essential to the present teachings and the present scroll compressor can be easily modified for use with internal combustion engines.

When the drive shaft 8 rotates together with the crank shaft 14, the crank shaft 14 revolves (orbits) around the rotational axis of the drive shaft 8. Also, the crank shaft 14 rotates around its rotating axis (same as the rotational axis of the crank shaft 14). However, the rotation preventing pin 36 only permits the movable scroll 20 to receive the orbital movement of the crank shaft 14 by means of the needle bearing 22. Further, the rotation of the crank shaft 14 will not be transmitted to the movable scroll due to the rotation preventing pin 36. As a result of the orbital movement of the movable scroll 20 with respect to the stationary scroll 2, refrigerant gas (fluid) is drawn from a suction port 44 into the compression chamber 32, which is defined between the stationary scroll 2 and the movable scroll 20. In conjunction with the revolution of the movable scroll 20, the surface of the rotation preventing pin 36 slides along the surface of the respective rotation preventing holes 40 and 42. The inner diameter "D" of the rotation preventing holes 40, 42, the outer diameter "d" of the rotation preventing pins 36, and the revolutionary (orbital) radius "r" of the bush 16 are preferably defined in a relationship such as "D=d+r". Due to this relationship, the revolutionary (orbital) radius of the movable scroll 20 is defined by "r", and the rotary ring 34 revolves at a radius that is one-half of the revolutionary radius "r" of the movable scroll 20.

While the crank shaft 14 rotates and revolves, the movable scroll 20 is prevented from rotating, because the inner circumferences of the respective rotation preventing holes 42 contact the rotation preventing pins 36 on the rotary ring 34.

When the crank shaft 14 rotates, the movable scroll 20 connected to the crank shaft 14 by means of the needle bearing 22 orbits around the rotational axis. When the movable scroll 20 orbits with respect to the stationary scroll 2, the refrigerant gas (fluid) is drawn from the suction port 44 into the compression chamber 32 and the compression chamber 32 reduces its volume toward the center of the scrolls 2, 20. Due to the volume reduction of the compression chamber 32, the refrigerant gas is compressed and reaches a high-pressure state.

The compressed high-pressure refrigerant gas is discharged from the discharge port 50 to the high-pressure chamber 53 when the discharge valve 52 opens the discharge port 50. The space 70 of the high-pressure chamber 53 communicates with the interior of the motor housing 6 via a passage 72 formed inside the crank shaft 14 and the drive shaft 8. Further, the refrigerant gas introduced into the motor housing 6 is discharged from the passage 74 provided in the drive shaft 8 to an external air conditioning circuit via an outlet 76 formed in a wall portion of the motor housing 6. Because the refrigerant gas is communicated through the interior of the motor housing 6, the refrigerant gas can cool the electric motor (i.e. rotor 48 and stator 46) during operation.

As shown in FIG. 2, a cylindrical space **16*b* is defined between the inner surface of the bush 16 and the outer surface of the crank shaft 14. The cylindrical space 16*b* includes a seal chamber 16*c* and a seal pushing chamber 16*d*. The seal 15 is disposed within the seal storage chamber 16*c* between the bush 16 and the crank shaft 14. The seal 15 separates the high-pressure chamber 53 from a low-pressure chamber 80 (see FIGS. 1 and 3). The seal pushing chamber 16*d* is provided adjacent to the side of the seal chamber 16*c* and communicates with the high-pressure chamber 53 via the clearance 16*a* between the bush 16 and the crank shaft 14. Therefore, high-pressure refrigerant gas within the high-pressure chamber 53 may be introduced into the seal pushing chamber 16*d*. Thus, the seal 15 is pushed toward the base plate 13 by the high-pressure refrigerant gas within the seal pushing chamber 16*d* and the seal 15 will contact the base plate 13**.

The seal 15 prevents the refrigerant gas from leaking from the high-pressure chamber 53 to the low-pressure chamber 80 (see FIGS. 1 and 3). The seal 15 preferably comprises an elastic material, such as rubber or other synthetic resin, and has a circular cross-section. By forming the seal 15 from an elastic material, the seal 15 can elastically deform when a force is applied to the seal 15. On the other hand, the bush 16 may possibly move to the outer surface of the crank shaft 14 with respect to the clearance **16*a* between the inner surface of the bush 16 and the outer surface of the crank shaft 14. When the bush 16 moves toward the crank shaft 14, the seal 15 receives the displacement of the bush 16 in the radial direction by elastically deforming. As the result, the bush 16 can be prevented from impacting against the crank shaft 14**.

As shown in FIG. 2, the seal 15 contacts not only the inner surface of the bush 16 and the outer surface of the crank shaft 14, but also the base plate 13. Thus, the sealing efficiency can be increased. Moreover, the height of the seal storage chamber **16*c* measured in the radial direction of the crank shaft 14 is greater than the height of the seal pushing chamber 16*d*. Therefore, when the bush 16 moves toward the base plate 13 (right in FIG. 2), a sealing portion 16*e* of the bush 16 pushes the seal 15 toward the base plate 13 and the sealing efficiency can be increased. Further, as was already explained above, because the high-pressure gas within the seal pushing chamber 16*d* pushes the seal 15 towards the base plate 13, a tight seal can be secured. Naturally, any biasing means, such as a spring, can be utilized to push the seal 15 toward the base plate 13**.

Further, it is preferable to provide a seal (not shown) between the outer surface of the bush 16 and inner surface of thee boss **24*a* in order to prevent the compressed high-pressure fluid from leaking to any lower-pressure space within the housing la via the clearance between the bush 16 and the boss 24*a*** For example, an elastically deformable annular ring or a plain bearing may be utilized as the seal.

Further techniques for making and using scroll compressors are taught in a US patent application filed on even date herewith entitled "Scroll Compressors" naming Naohiro Nakajima, Hiroyuki Gennami, Kazuhiro Kuroki, Kazuo Kobayashi, Shinji Tsubai and Yasushi Watanabe as inventors and claiming Paris Convention priority to Japanese patent application serial number 2000-282276 and a US patent application filed on even date herewith entitled "Scroll Compressors" naming Hiroyuki Gennami, Kazuhiro Kuroki, Kazuo Kobayashi, Shinji Tsubai, Naohiro Nakajima and Masahiro Kawaguchi as inventors and claiming Paris Convention priority to Japanese patent application serial number 2000-280457, all of which are commonly assigned and are incorporated by reference as if fully set forth herein.

What is claimed is:

1. A scroll compressor comprising:

a stationary scroll;

a drive shaft;

a crank shaft coupled to the drive shaft;

a bush coupled to the outer surface of the crank shaft;

a seal disposed between the bush and the crank shaft, wherein the seal is elastically deformable in the radial direction of the crank shaft;

a movable scroll coupled to the crank shaft, the movable scroll disposed adjacent to the stationary scroll;

a compression chamber defined by a space between the stationary scroll and the movable scroll, wherein fluid is compressed within the compression chamber when the movable scroll revolves or orbits with respect to the stationary scroll;

a high-pressure chamber at least partially defined by the seal and the movable scroll; and a discharge port defined within the movable scroll and adapted to release the compressed fluid to a side that is opposite of the stationary scroll, wherein the discharge port communicates with the high-pressure chamber.

2. A scroll compressor according to claim 1, wherein the seal is an annular ring that is elastically deformable in the radial direction of the crank shaft.

3. A scroll compressor according to claim 1, further comprising a base plate disposed between the drive shaft and the crank shaft, the seal contacting the base plate.

4. A scroll compressor according to claim 3, wherein the seal is pushed towards the base plate by compressed fluid from the discharge port.

5. A scroll compressor according to claim 1, wherein the seal is disposed within a seal receiving space between the bush and the crank shaft, the height of the seal receiving space measured in the radial direction of the crank shaft is greater than the height of the clearance between the bush and the crank shaft.

6. A scroll compressor according to claim 1, further comprising an electric motor disposed within a motor housing, wherein the motor housing is in communication with the discharge port, the electric motor is coupled to and drives the drive shaft and wherein compressed fluid from the compression chamber is introduced into the motor housing via the discharge port in order to cool the electric motor during operation.

7. A scroll compressor comprising:

a stationary scroll;

a drive shaft;

a crank shaft coupled to the drive shaft;

a bush coupled to the outer surface of the crank shaft;

a movable scroll coupled to the crank shaft, the movable scroll disposed adjacent to the stationary scroll;

a compression chamber defined by a space between the stationary scroll and the movable scroll, wherein fluid is compressed in the compression chamber when the movable scroll revolves or orbits with respect to the stationary scroll;

a discharge port defined within the movable scroll and adapted to release the compressed fluid to a side that is opposite the stationary scroll; and means for sealing the clearance between the bush and the crank shaft in the radial direction of the crank shaft, wherein the sealing means prevents the high-pressure fluid compressed in the compression chamber from leaking to a lower pressure space within the scroll compressor via a clearance between the bush and the crank shaft.

8. A scroll compressor according to claim 7, wherein the sealing means comprises an elastic resin material.

9. A scroll compressor according to claim 7, further comprising a high-pressure chamber at least partially defined by the sealing means and the movable scroll, wherein the discharge port communicates with the high-pressure chamber.

10. A scroll compressor according to claim 9, wherein the sealing means is an annular ring that is elastically deformable in the radial direction of the crank shaft.

11. A scroll compressor according to claim 10, further comprising a base plate disposed between the drive shaft and the crank shaft, the sealing means contacting the base plate.

12. A scroll compressor according to claim 11, wherein the scaling means is pushed towards the base plate by compressed fluid from the discharge port.

13. A scroll compressor according to claim 12, wherein the sealing means is disposed within a seal receiving space defined between the bush and the crank shaft, the height of the seal receiving space measured in the radial direction of the crank shaft Is greater than the height of the clearance between the bush and the crank shaft.

14. A scroll compressor according to claim 13, further comprising an electric motor disposed within a motor housing, wherein the motor housing is in communication with the discharge port, the electric motor is coupled to and drives the drive shaft and wherein compressed fluid from the compression chamber is introduced into the motor housing via the discharge port in order to cool the electric motor during operation.

15. A scroll compressor comprising:

a stationary scroll;

a drive shaft;

a crank shaft coupled to the drive shaft;

a bush coupled to the outer surface of the crank shaft;

a seal disposed within a seal receiving space between the bush and the crank shaft, wherein the seal is elastically deformable in the radial direction of the crank shaft and the height of the seal receiving space measured in the radial direction of the crank shaft is greater than the height of the clearance between the bush and the crank shaft;

a movable scroll coupled to the crank shaft, the movable scroll disposed adjacent to the stationary scroll;

a compression chamber defined by a space between the stationary scroll and the movable scroll, wherein fluid is compressed within the compression chamber when the movable scroll revolves or orbits with respect to the stationary scroll; and a discharge port defined within the movable scroll and adapted to release the compressed fluid to a side that is opposite of the stationary scroll.

* * * * *